US005442873A

United States Patent [19]

Vogler

[11] Patent Number: 5,442,873

[45] Date of Patent: Aug. 22, 1995

[54] MOLDED PLASTIC PLACARD DISPLAY FRAME

[76] Inventor: Michael N. Vogler, 49 Miranda Ct., Thornhill, Ontario, Canada

[21] Appl. No.: 164,541

[22] Filed: Dec. 10, 1993

[51] Int. Cl.[6] ..... G09F 3/20

[52] U.S. Cl. ..... 40/649; 40/611; 40/159

[58] Field of Search ..... 40/152, 154, 159, 642, 40/649, 611, 490, 537

[56] References Cited

U.S. PATENT DOCUMENTS

| | | | |
|---|---|---|---|
| 4,270,290 | 6/1981 | Eckert | 40/537 X |
| 4,682,430 | 7/1987 | Ramsay | 40/649 X |
| 5,331,756 | 7/1994 | Rehrig | 40/308 |

FOREIGN PATENT DOCUMENTS

| | | | |
|---|---|---|---|
| 227626 | 9/1943 | Switzerland | 40/649 |
| 2167590 | 5/1986 | United Kingdom | 40/649 |

*Primary Examiner*—Brian K. Green
*Attorney, Agent, or Firm*—William J. Daniel

[57] ABSTRACT

A unitary injection-molded plastic holder frame for displaying an advertising placard or the like has four frame sides connected at their ends into a rectangle, a contiguous trio of the sides having generally coplanar mutually directed shallow channels therein for receiving the side margins along three sides of the placard with the remaining frame side being slotted along its length to separate that side into two parallel frame strip. The slot is in coplanar relation to said shallow channels and communicates at its ends with the corresponding ends of the channels in two opposite frame sides whereby the placard can be inserted via the slot into the frame with the margins of its three sides protruding into said channels. Detent means is provided for positively retaining said placard in its inserted position within said frame, in the form at least one nib carried on an inner face of at least one of the frame strips projecting toward the opposite strip substantially into contact with the inner face of said opposite strip face and preventing the accidental passage of said placard through said slot. Preferably, each nib has an inclined edge extending from a point adjacent the inner side of the frame strip to a point adjacent its outer side and sloping in the direction from the inner to the outer side toward the opposite frame strip, the inclined edge facilitating the intentional passage of the placard past the nibs for removal from the frame.

3 Claims, 1 Drawing Sheet

MOLDED PLASTIC PLACARD DISPLAY FRAME

FIELD OF THE INVENTION

This invention relates to a display frame for placards, signs and the like used especially for merchandizing purposes, such as the display to the purchasing public at the point of sale of goods and products of advertising matter, pricing data and similar information, and is directed more particularly to a display frame that can be molded inexpensively in an attractive form from light weight and durable plastic.

BACKGROUND OF THE INVENTION

It is common for a variety of goods and products to be stocked, often in quantity, for sale by merchants on shelves, racks, cases, bins, etc. for inspection and selection by consumers. The display of pricing information at the location of each particular product, i.e. at the point of sale, is ordinarily necessary as price tends to be a major factor in product choice. Moreover, certain products are often promoted or emphasized for sale at certain times by means of advertisement and/or price reduction and the display to the potential purchaser of the desired advertising or other promotional information or reduction in price can be critical to the success of such promotion.

While small pricing tickets or tags can be attached, e.g. clipped, as is the usual practice, to an edge of the shelf or rack in proximity to each group of products, the amount of information that can be provided on tickets or tags is quite limited, being usually restricted to identity and price alone, making the exhibition of appealing advertising material to entice an undecided customer almost out of the question. In any event, this kind of display lacks the distinctive character required for significant impact on the perception of a prospective purchaser in that it does not differentiate from regular pricing tickets or stand out from the remainder of the merchandize in the area.

Hence, merchants have addressed this problem by means of special displays that can be associated in one way or another with a group of products and can carry sufficient information to entice the attention of a passing customer and induce him or her to pause and examine the particular merchandise. Various devices have been proposed in the art for this purpose. For example, U.S. Pat. No. 1,996,616 shows a holder for an advertising insert having a solid metal sheet with its margins on three sides folded re-entrantly to define shallow channels for the reception of three edges of an insert sheet inserted through the open remaining side thereof. Pivotable ears are provided on the holder at two spaced points adjacent the fourth edge of the insert which can be pivoted over that edge to act as spring clamps holding the insert in place. The metal sheet is extended on its fourth side and bent into a hook for anchorage to a suitable support.

A somewhat similar holder is found in U.S. Pat. No. 2,581,742 except that the metal sheet is folded on two opposite side margins into U-shaped channels and the remaining two opposite side edges are bent into lips projecting angularly to the body of the sheet forming the back wall of the holder. A sign to be displayed is passed at an angle over one of the lips until its leading edge at its margins slides into the open ends of the two opposite channels and then advanced along the channels until its trailing edge has cleared the lip. The sign then lies flat against the back wall with two opposite edges seated within the channels and is prevented from inadvertent displacement from the holder is prevented by the projecting lips but can be forcibly removed by bending one of its margins angularly clear of the adjacent lip and sliding the bent sign laterally out of the holder. This holder includes a stake for placement in the ground but could instead be easily adapted for attachment to supports of the kind found in stores.

While display holders of the structure just described certainly are capable for carrying out the function desired, the stamping and shaping of metal sheets is relatively expensive, bearing in mind the need for a considerable number of display holders for every store. In addition, the need for at least one edge of the holder to be exposed, i.e. not folded into a channel, to enable the placard to be inserted in place lends an unfinished appearance that suggests a "bargain basement" and is not as aesthetically attractive as is demanded in shops offering higher quality merchandise which often adopt an elaborate and expensive decor.

To some extent, the above problems are avoided in the display holder found in U.S. Pat. No. 2,981,018 where the frame is formed from either metal or plastic and has three sides shaped to define mutually facing channels arranged in "U" fashion, the fourth side, i.e. along the top of the latter "U", being slotted along its length with the slot opening in registration with the channel openings. Thus, a placard can be passed through the slot of the slotted side until its margins are engaged in the channels of the three sides. To insure that the placard does not become dislodged from the holder, a spring finger is riveted at one end in one of the channels adjacent the open end of the channel proximate to the slotted side of the frame. The spring finger is biased away at its other end from the base of the channel to yieldably contact the corner edge of an inserted placard and create a frictional resistance to movement of the placard. The extreme end of the finger projects through the slot exteriorly of the frame for engagement by hand to release the spring pressure and free the placard for removal from the frame.

Despite its improvement over earlier forms, the latter display frame requires special assembly of the spring finger which is a costly additional manufacturing step. Moreover, it may be desirable in some instances to utilize thin paper display signs which lack the stiffness to effectively resist the pressure of the spring finger so that such signs become creased and "dog-eared", detracting from the display.

In a somewhat different vein, slotted holders for one or a plurality of plastic cards, such as a driver's license or credit cards, have been proposed as in U.S. Pat. No. 2,629,952 and 4,674,628, which include projections proximate the internal limits of the slots for engaging the plastic card near its innermost extremity. In the formers a back wall of the holder carries an internal shouder for engagement with a lip deformed at one end of the card while in the latter, the side walls of a plurality of parallel channels each receiving a side margin of a card inserted therein carry at their interior ends opposed protrusions for pinching the margin of as fully inserted card. In either instance, the entry opening of the slots of these holders is unrestricted and the plastic card must possess considerable regidity.

OBJECTS OF THE INVENTION

The essential object of the present invention is a simple display frame that can be injection-molded at low cost in one piece and that incorporates in a concealed or "invisible" location detent means for retaining a display sheet or card in place within the frame that is operative for sheets or cards of varying thickness and avoids the slightest mutilation of the sheets or cards.

Another object of the invention is a display frame of the type in question wherein the detent means is created as an incident to the molding operation eliminating the need for any extra assembly step.

BRIEF DESCRIPTION OF THE ACCOMPANYING DRAWINGS

An illustrative embodiment of a display frame according to the present invention is shown in the accompanying drawings, in which FIG. 1 is a plan view showing the frame having one slotted side for insertion of a display placard therein, the placard for sake of visibility being indicated in broken lines in partially inserted position within the frame;

FIG. 2 an enlarged detail view, partially in cross-section, of the slotted side on the frame of FIG. 1, with the display placard being omitted therefrom, one side of the slot being cut away to reveal placard detent means disposed within the slot.

FIG. 3 is an enlarged detail view taken In section transversely of the slotted side of the frame along line 3—3 in FIG. 2, showing the profile of an "outboard" detent means;

FIG. 4 is an enlarged detail sectional view similar to FIG. 3 taken along line 4—4 of FIG. 2, showing the profile of an "inboard" detent means; and FIG. 5 is an enlarged detail sectional view similar to FIGS. 3 and 4 taken along line 5—5 of FIG. 3, showing the configuration of the side channels of the frame.

DETAILED DESCRIPTION OF ILLUSTRATIVE EMBODIMENT

Figure 1:
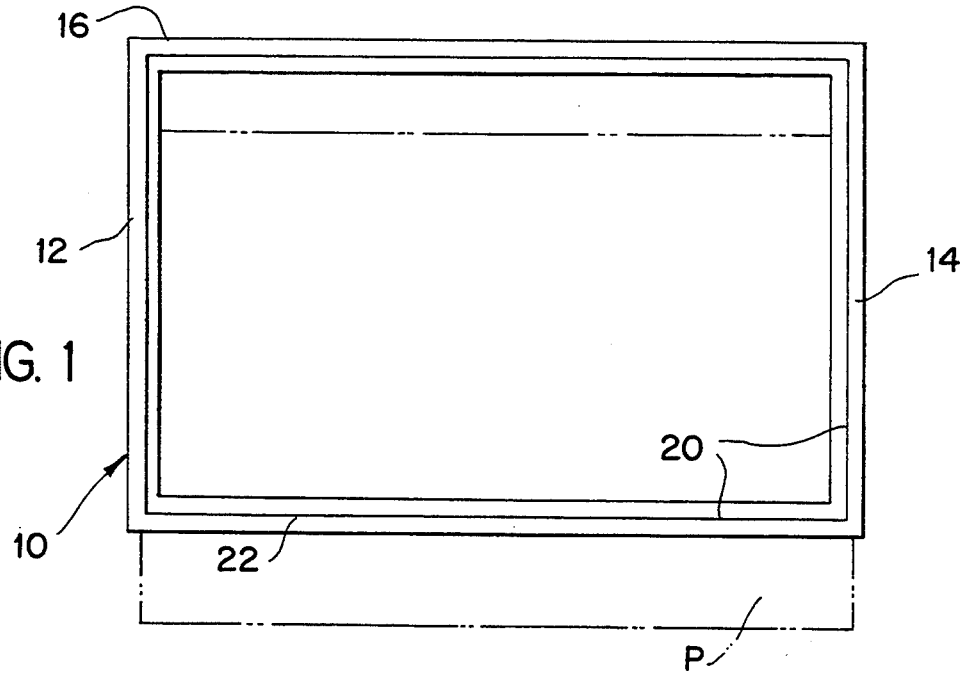

In a preferred embodiment as illustrated in the drawings, the display frame of the invention, generally designated 10, is injection-molded in one piece from e.g. high impact polystyrene and consists of two pairs of elongated frame sides, the ends of each side of one pair being joined integrally to the corresponding ends of the sides of the opposite pair to form a rectangular open frame. The length of the respective pairs is dependent on the size of the placard,sign or sheet card, designated P, to be displayed therein. As examples, a small size frame might be about 5"×7" while a larger size might be about 7"×11" but ether sizes are equally possible. If desired, a solid back wall could be included but is preferably omitted, as shown, to reduce material costs and, more importantly, permit the display placard or sheet held by the frame to be visible from both sides rather than only one side.

Figure 5:
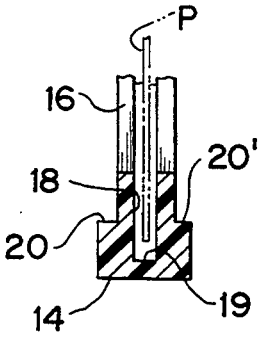

Three adjacent sides 12, 14, and 16 are molded with inwardly opening or mutually facing shallow U-shaped channels extending longitudinally thereof, all of which are similarly configured to that shown at 18 for side 14 in FIG. 5 sides 12 and 14 are mirror images of one another. Preferably the exterior faces of the respective sides are attractively contoured similar to ornamental plaster or wood moldings as indicated by the steps 20 and present on the side 14 in FIG. 5. The corners of the steps can be square or rounded, as desired.

The opposite ends of the channel in side 16 are connected to one end of each of the channels of sides 12 and 14 to thereby define a continuous U-shaped channel for receiving the margins on three corresponding sides of the display placard or sheet "P", which is shown in broken lines in partially inserted position in the frame 10 in FIG. 1 in order to be visible in the view. The thickness or transverse dimension of the channel can vary and is selected to accommodate easily placards up to a thickness corresponding to card boards poster board or the like, a suitable example of channel thickness being about 3/32" to ⅛". The depth of the channel can likewise vary only so long as a sufficient margin of the placard is received thereins say at least about ¼". For a frame side having an "annular" dimension, i.e. parallel to the plane of the frame, of about 7/16" to ½", the channel can, for example, have a depth of about 67/16". This leaves a bottom wall 19 for the channel of about 1/16" thickness which has been found to give a satisfactory rigidity to the frame although it could be increased if desired and the channel depth correspondingly reduced.

The remaining fourth side 22 of frame 10 is slotted lengthwise, as at 24, to permit the introduction of the display card P into the frame. The slot 24 corresponds in thickness to that of the channels of the three other sides, e.g. channel 18, resembling the latter channels except for the elimination of the channel bottom wall 19 so that the slot passes entirely through frame side 22. At its extreme ends, slot 24 merges or communicates with the adjacent ends of the channels in an opposite pair 12 and 14 of the other sides, thereby dividing the fourth side 22 into parallel strips 26 and 26' separated by the slot 24. The strips 26 and 26' are relatively flexible and can be separated at their midpoint up to a maximum of about ½" for the smaller of the above specified frame sizes and about 1" for the larger size.

In accordance with the invention, detent means are formed within the slot 24 as projections on the inner side of at least one of the strips 26, 26' for the purpose of engaging either a surface or an edge of a display placard inserted within the frame 10 and prevent the same from falling out of the frame when in a position with the slotted side 22 directed downwardly. The detent projections take the form of small nibs or toothlike projections 28 molded on the inner face of at least one of the strips 26, 26' and projecting from that face toward the opposite face so as to essentially bridge the slot 24.

It is important for secure engagement of even very thin and flexible display sheets e.g. with a thickness more or less equal to that of bond papers that the projection of the nibs 28 be sufficient to substantially make contact with the inner face of the opposite frame strip when the two strips are in their normal position. In this connection, it has been noted that when strips 26, 26' are in a "relaxed" condition, i.e. are free of stress tending to separate them, they tend normally to flex slightly toward one another so that the thickness of slot 24 at the center of the frame side 22 is slightly less than the thickness at its extreme ends. Consequently, the projection of nibs 28 need not precisely equal the thickness of slot 24 for effective contact to be made with the opposite strip. If the projection does equal the thickness of the channel 18, then the tendency of the strips to assume a slightly flexed relationship serves to urge the nibs into contact with the opposite frame strip and thereby increase the resistance holding the placard within the frame.

Contrary to what might be expected, it is undesirable that the edges of the nibs 28, and especially the inner edge thereof, be square or blunt. Although a square inner edge would certainly provide the maximum deterrent to accidental displacement of the display card from the frame by direct abutment with the side edge of a placard suitably dimensioned to fit entirely within the frame without gaps or spaces, which is the preferred and recommended size for the placard, it constitutes an equally effective deterrent to the intentional withdrawal of the display card from the frame. Removal of a card and replacement with a fresh card is, of course, eventually necessary in any case, and may indeed be a frequent occurrence and with a large number of display frames, quick and easy withdrawal is important. With a card in place within the frame and given the location of the detent means within the slot of the slotted side of the frame, grasping of the strips of the slotted side to separate the same for guiding of the card edge past blunt-ended nibs is awkward and slow at best because interference of the card.

Therefores one of the features of the invention is the provision of a sloping end on at least the inner end of the detent nibs. The slope can be slight, approaching a rounding, but it is advantageous and preferred that the free or projecting, i. e. inner, edge of each nib is gradually inclined or sloped, as at 30, from a substantially coplanar condition at its inner end with the inner face of the strip carrying the same to a maximum projection or height above that face substantially making contact with the inner face of the opposite strip.

Figure 3:
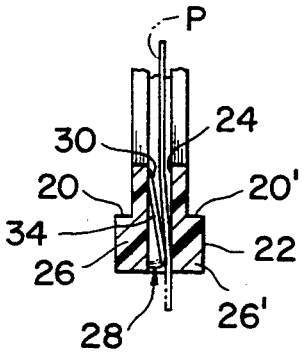
Figure 4:
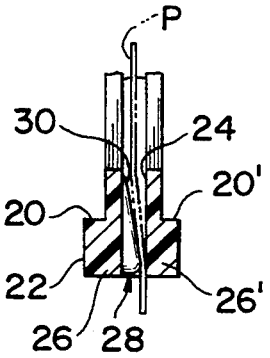

The free edge of the nib could be inclined from both its inner and outer ends towards a center peak, thereby facilitating to some degree both the insertion and withdrawal of the display card relative to the frame. But it is preferred that the inclination extend from the inner nearly to the outer end of the nib and that the outer corner of the nib be merely rounded, as is depicted in FIGS. 3 and 4. Insertion of the display card into the slotted frame side is less troublesome than the withdrawal thereof since for the former there is no card present within the frame and grasping of the respective strips to separate the same with the fingers is much easier. The gradually inclined nip edge acts to "cam" the frame strips apart as the placard edge begins to move through the slot on the way out of the frame so that less force must be exerted on e.g. thin flexible sheets as placards.

The number, location, and thus the separation along side 22 of nibs 26 can be adjusted but it is preferred, notably for large size frames, that there be at least three nibs which can be equi-distant apart or more preferebly, one at the mid-point and the other two placed somewhat nearer the side frames 12, 14. The latter arrangement gives effective retention of even less than full size placards. For smaller size frames, fewer nibs e.g. ones might suffice while for very large frames, more than three. g. four or five, might be advisable.

Figure 2:
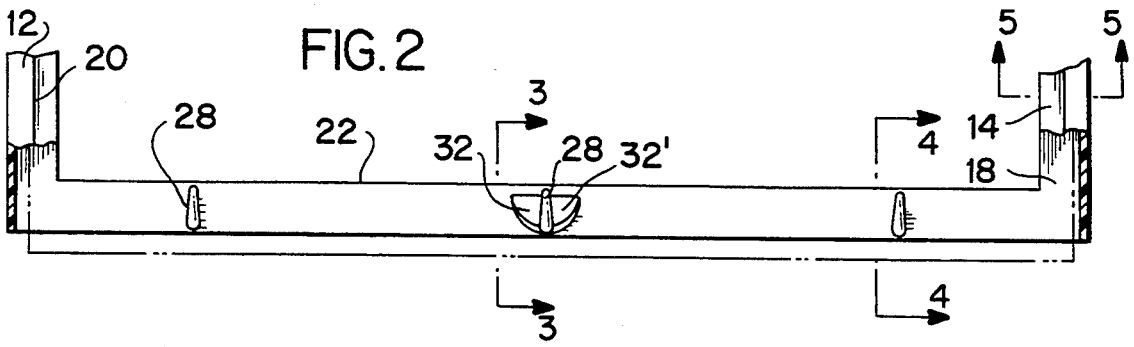

The exact configuration of the individual nibs can differ. As seen in FIG. 2, the central or "inboard" nib includes lateral shoulders 32, 32' due to a design evolution. Intially, frame 10 was constructed with only a central detent projection formed by what now constitutes the shoulders joined together and it was discovered that the height thereof above the face of the underlying strip was insufficient to accomplish secure engagement of an inserted placard. To overcome this problems an intermediate higher "extension" 34 was added together with the two "outboard" nibs in entirety but to avoid the need for constructing an entirely new injection mold, the shoulder regions 32, 32' were left in place. Thus, the shoulders 32, 32' are not essential to the structure and can be discarded but it has been found that their presence confers some added strength.

The details of the injection molding technique employed for the invention will be obvious to one skilled in that art and a description thereof is not needed here. It can be remarked that the provision of an inclined edge 34 on the respective detent nibs aids in the removal of certain mold parts. The slot in side 22 of the display frame and the channels in the sides 12, 14, and 16 thereof are created by the presence within the mold cavity of a tongue-like plate having recesses therein at appropriate sites to form the detent projections or nibs 28. Withdrawal of this plate is facilitated by the presence of the inclined edges 34 on those projections or nibs.

The shape in plan of the detent projections can obviously be altered rather widely. They can be tapered slightly, as shown, toward their inner ends or towards their outer ends or they can be flared laterally, i.e. extended longitudinally of the strips similar to the shoulders 32, 32'. Instead of the detent projections being all carried on the same frame strip, they can be distributed between the two strips. However, this presents a complication in the design of the mold without any apparent benefit or advantage.

It is preferred that the placard, sign or advertising sheet be of a size such as to fit entirely within the frame, i.e. with three of its side margins protruding into the channels 18 of the frame sides 12, 14, and 16 and the edge along the remaining side just in contact with the inclined inner edges of the detent projections. Oversize placards of a length exceeding that of sides 12 and 14 can be accommodated with the excess length extending exteriorly of the slotted side 22. In that case, the detent projections simply contact a surface of the placard with equally effective retention of the placard. As mentioned before, undersize cards can likewise be fitted within the frames of the invention.

It is within the scope of this invention to mold the respective sides of the display frame individually and then assemble the same into an integral rectangular unit by plastic adhesives and the like. However, this technique significantly increases the cost of manufacture and is less preferred.

During the course of the preceding description, a number of possible alternatives or moadifications have been noted. It will be appreciated, however, that other additional changes will be within the skill of those familiar with the art. Hence, the invention should be interpreted as limited only as required by the appended claims.

That which is claimed is:

1. A unitary injection-molded plastic holder frame for displaying advertising placards which comprises four frame sides connected at their ends into a rectangle, said four frame sides having inner edges defining a rectangular opening, a contiguous trio of said sides having generally coplanar mutually directed shallow channels therein for receiving side margins of said placard along three sides of said placard with the remaining frame side being slotted along its length between two parallel frame strips in coplanar relation to said shallow channels, said slot communicating at its ends with corresponding ends of the channels in two opposite frame sides, whereby said placard can be inserted via said slot into the frame with the margins of its said three sides seated in said channels, and detent means for positively retaining said placard in its inserted position within said frame, said detent means comprising at least one nib carried on an inner face of at least one of said frame strips projecting toward the opposite strip into contact with the inner face thereof and preventing the accidental passage of said placard through said slot, each said nib having an inclined face extending from a point generally adjacent an inner edge of the frame strip to a point generally adjacent an edge of said strip opposite said inner edge, said inclined face sloping in a direction extending from said inner edge to said outer edge toward the opposite frame strip, said inclined face facilitating the intentional removal of the placard from the frame.

2. The frame of claim 1 wherein an end of said inclined face of each said nib adjacent said opposite edge of said strip is rounded to facilitate the insertion of the placard within the frame.

3. The frame of claim 1 wherein said frame sides have opposite faces that are contoured for ornamental effect.

* * * * *